US010934051B1

(12) United States Patent
Harnack et al.

(10) Patent No.: US 10,934,051 B1
(45) Date of Patent: Mar. 2, 2021

(54) SELF-ACTIVATED CONTAINER

(71) Applicant: International Business Machines Corporation, Armonk, NY (US)

(72) Inventors: Tate Thomas Harnack, Rochester, MN (US); Taylor Ann Poss, St. Michael, MN (US); Jerael Kayne Eddy, Lanesboro, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/535,311

(22) Filed: Aug. 8, 2019

(51) Int. Cl.
*B65D 5/20* (2006.01)
*B65D 5/42* (2006.01)

(52) U.S. Cl.
CPC ..... *B65D 5/2052* (2013.01); *B65D 5/4266* (2013.01)

(58) Field of Classification Search
CPC .... B65D 5/2052; B65D 5/4266; B65D 5/443; B65D 5/0025; B65D 5/22; B65D 5/0015; B65D 5/20; B31B 2100/00; B31B 50/26
USPC ..... 229/126, 918, 178, 919, 143; 206/509, 206/45.21; 220/62
See application file for complete search history.

(56) References Cited

U.S. PATENT DOCUMENTS 3,102,674 A * 9/1963 Hamilton ..... B65D 5/4295 229/117.21
4,101,048 A * 7/1978 Rieben ..... B65D 5/0045 229/117.16
4,946,093 A 8/1990 Moorman
5,649,663 A * 7/1997 Pestow, Jr. ..... B65D 5/0045 229/190
5,975,413 A 11/1999 Moen
5,996,885 A 12/1999 Chu
6,116,498 A * 9/2000 Sheffer ..... B65D 5/0035 229/114
9,045,251 B2 6/2015 Sanchez et al.
9,045,252 B2 6/2015 Hallam
10,220,588 B2 3/2019 Wiley
2005/0145687 A1* 7/2005 Conway ..... B65D 5/0045 229/174
2010/0147840 A1 6/2010 Dowd
2017/0197750 A1 7/2017 Wolf et al.
2018/0127148 A1 5/2018 Kuhn et al.

FOREIGN PATENT DOCUMENTS

FR 2832696 A1 5/2003
GB 2105308 A 3/1983

* cited by examiner

*Primary Examiner* — Christopher R Demeree
(74) *Attorney, Agent, or Firm* — Jorge R. Maranto

(57) ABSTRACT

Various embodiments are directed to a blank and method for forming a self-activated container. The panel including a plurality of panels connected together at fold lines configured for extending around an interior space, including a base panel, a front panel, a back panel, a first outer side panel, and a second outer side panel. Also included with the blank are a pair of front inner side panels, a front minor flap, a pair of front support flaps, a pair of back inner side panels, a back minor flap, a pair of back support flaps, a first major flap, and a second major flap.

13 Claims, 4 Drawing Sheets

SELF-ACTIVATED CONTAINER

BACKGROUND

The present disclosure relates to containers, and more specifically, to a blank and container that combines the features of a half-slotted container and a tray.

Half slotted containers and trays are typically used to ship products such as storage systems, flash systems, and servers. Glue and staples can be used to hold the half-slotted container in place. Clips can then be used to connect the half-slotted container to the tray to complete the interior enclosure around a product. For some larger products, such as flash systems, removal of the product from the tray and half-slotted container can be time consuming and difficult. For instance, to unbox a product, the clips are removed, and the half-slotted container is pulled up from the product and packaging which can become difficult. Also, breaking down the half-slotted container for disposal or recycling can also take time as glue and staples are used to form the container, and therefore must be removed prior to disposal.

SUMMARY

Various embodiments are directed to a blank for forming a self-activated container. The panel including a plurality of panels connected together at fold lines configured for extending around an interior space, including a base panel, a front panel, a back panel, a first outer side panel, and a second outer side panel. Also included with the blank are a pair of front inner side panels foldably connected to opposed edges of the front panel, a front minor flap foldably connected to a top edge of the front panel, a pair of front support flaps foldably connected to the top edge of the front panel and on opposed sides of the front minor flap, a pair of back inner side panels foldably connected to opposed edges of the back panel, a back minor flap foldably connected to a top edge of the back panel, a pair of back support flaps foldably connected to the top edge of the back panel and on opposed sides of the back minor flap, a first major flap foldably connected to a top edge of the first outer side panel, and a second major flap foldably connected to a top edge of the second outer side panel. A first one of the front inner side panels, a first one of the back inner side panels, the first outer side panel are configured to form a first assembled side panel. A second one of the front inner side panels, a second one of the back inner side panels, the second outer side panel are configured to form a second assembled side panel. The pair of front support flaps and the front panel are configured to form an assembled front panel. The pair of back support flaps and the back panel are configured to form an assembled back panel. The first major flap, the second major flap, the front minor flap, and the back minor flap are configured to form an assembled top panel.

Further embodiments are directed to a container including a plurality of panels extending at least partially around an interior space, including a base panel connected to a front panel, a back panel, a first outer side panel, and to a second outer side panel. The container can also include a pair of front inner side panels foldably connected to opposed edges of the front panel, a front minor flap foldably connected to a top edge of the front panel, a pair of front support flaps foldably connected to the top edge of the front panel and on opposed sides of the front minor flap, a pair of back inner side panels foldably connected to opposed edges of the back panel, a back minor flap foldably connected to a top edge of the back panel, a pair of back support flaps foldably connected to the top edge of the back panel and on opposed sides of the back minor flap, a first major flap foldably connected to a top edge of the first outer side panel; and a second major flap foldably connected to a top edge of the second outer side panel. A first one of the front inner side panels, a first one of the back inner side panels, and the first outer side panel are configured to form a first assembled side panel. A second one of the front inner side panels, a second one of the back inner side panels, and the second outer side panel are configured to form a second assembled side panel. The pair of front support flaps and the front panel are configured to form an assembled front panel. The pair of back support flaps and the back panel are configured to form an assembled back panel. The first major flap, the second major flap, the front minor flap, and the back minor flap are configured to form an assembled top panel.

BRIEF DESCRIPTION OF THE DRAWINGS

These and other features, aspects, and advantages of the embodiments of the disclosure will become better understood with regard to the following description, appended claims, and accompanying drawings where:

Figure 1:
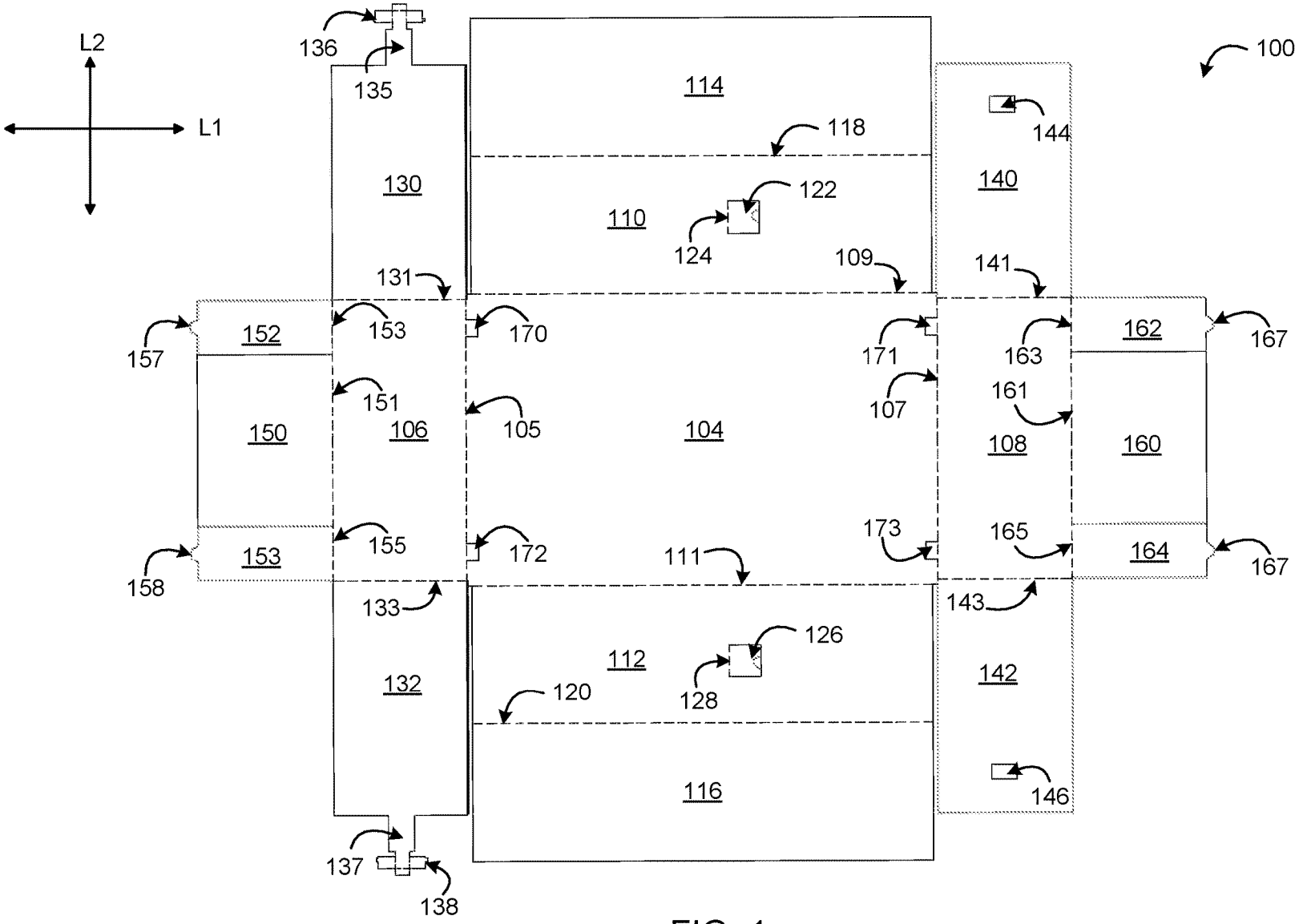
FIG. 1 is a plan view of a blank for forming a container, according to embodiments of the present disclosure.

While the present disclosure is amenable to various modifications and alternative forms, specifics thereof have been shown by way of example in the drawings and will be described in detail. It should be understood, however, that the intention is not to limit the particular embodiments described. On the contrary, the intention is to cover all modifications, equivalents, and alternatives falling within the scope of the present disclosure. Like reference numeral are used to designate like parts in the accompanying drawings.

DETAILED DESCRIPTION

Containers according to embodiments of the present disclosure can accommodate articles of numerous different shapes. In this specification, the terms "base", "side", "front", "back", and "top" indicate orientations determined in relation to fully erected containers. As described herein, containers may be formed by multiple overlapping portions, panels, and/or flaps. Such portions, panels, and/or flaps may be designated in relative terms to one another (e.g., "first", "second", "third", etc.) in sequential or non-sequential reference, without departing from the disclosure.

FIG. 1 is a plan view of a blank 100 for forming a container 101, according to embodiments of the present disclosure. The blank 100 includes a base panel 104, a front panel 106, a back panel 108, a first side panel 110, a second side panel 112, major flaps 114 and 116, front inner side panels 130 and 132, back inner side panels 140 and 142, a front minor flap 150, front flap supports 152 and 154, a back minor flap 160, and back support flaps 162 and 164. In some embodiments, the base panel 104 can include apertures 170, 171, 172, and 173. The front support flaps can include tabs 157 and 158. The back support flaps can include tabs 167, 168. The front inner side panels 130, 132 can include winged tabs 135, 137, respectively. The back inner side panels can include apertures 144 and 146. The side panels 110, 112 can include activation windows 122, 126, respectively. The blank 100 and the panels and flaps thereof can be of any suitable material such as a corrugated board material.

As shown in FIG. 1, the blank 100 has a longitudinal axis L1 extending generally in the direction of the length of the blank 100 and a lateral axis L2 extending generally in the direction of the width of the blank 100. The base panel 104 connects together at fold lines configured for extending, at least partially, around an interior space. The base panel 104 is foldably connected to the front panel along lateral fold line 105. The base panel is also foldably connected to the side panel 110 along longitudinal fold line 109 and foldably connected to side panel 112 along longitudinal fold line 111. The base panel is further foldably connected to the back panel 108 along lateral fold line 107. As also shown, apertures 170 and 172 can be provided that interrupt portions of the fold line 105 in the base panel 104. Apertures 171 and 173 can also be provided that interrupt portions of the fold line 107 in the base panel 104.

The front panel 106 is foldably connected to the front minor flap 150, the front support flap 152, and the front support flap 154 along lateral fold line 151. The front panel 106 is also foldably connected the front inner side panel 130 along longitudinal fold line 131. The front panel is also foldably connected to the front inner side panel 132 along longitudinal fold line 133.

Also shown, tab 157 can be provided along the lateral edge of the front support flap 152. Tab 158 can also be provided along the lateral edge of the front support flap 154. Tab 135 with latch 136 can be provided along the longitudinal edge of the front inner side panel 130. Also, tab 137 with latch 138 can be provided along the longitudinal edge of the front inner side panel 132.

The side panel 110 is foldably connected to the major flap 114. Also shown, the activation window 122 is foldably connected to the side panel 110 along lateral fold line 124. The activation window 122 being positioned along the interior of the side panel 110. An indention can interrupt the lateral edge of the activation window 122 which provides a means for rotating the activation window 122 along the lateral fold line 124.

The side panel 112 is foldably connected to the major flap 116. Also shown, the activation window 126 is foldably connected to the side panel 112 along lateral fold line 128. The activation window 126 being positioned along the interior of the side panel 110. An indention can interrupt the lateral edge of the activation window 126 which provides a means for rotating the activation window 126 along the later fold line 128.

The front panel 108 is foldably connected to the front minor flap 150, the front support flap 162, and the front support flap 164 along lateral fold line 161. The front panel 108 is also foldably connected to the front inner side panel 140 along longitudinal fold line 141. The front panel is also foldably connected to the front inner side panel 142 along longitudinal fold line 143.

Also shown, tab 167 can be provided along the lateral edge of the front support flap 162. Tab 168 can also be provided along the lateral edge of the front support flap 164. Aperture 144 can be provided within the front inner side panel 140 and aperture 146 can be provided within the front inner side panel 142.

Figure 2:
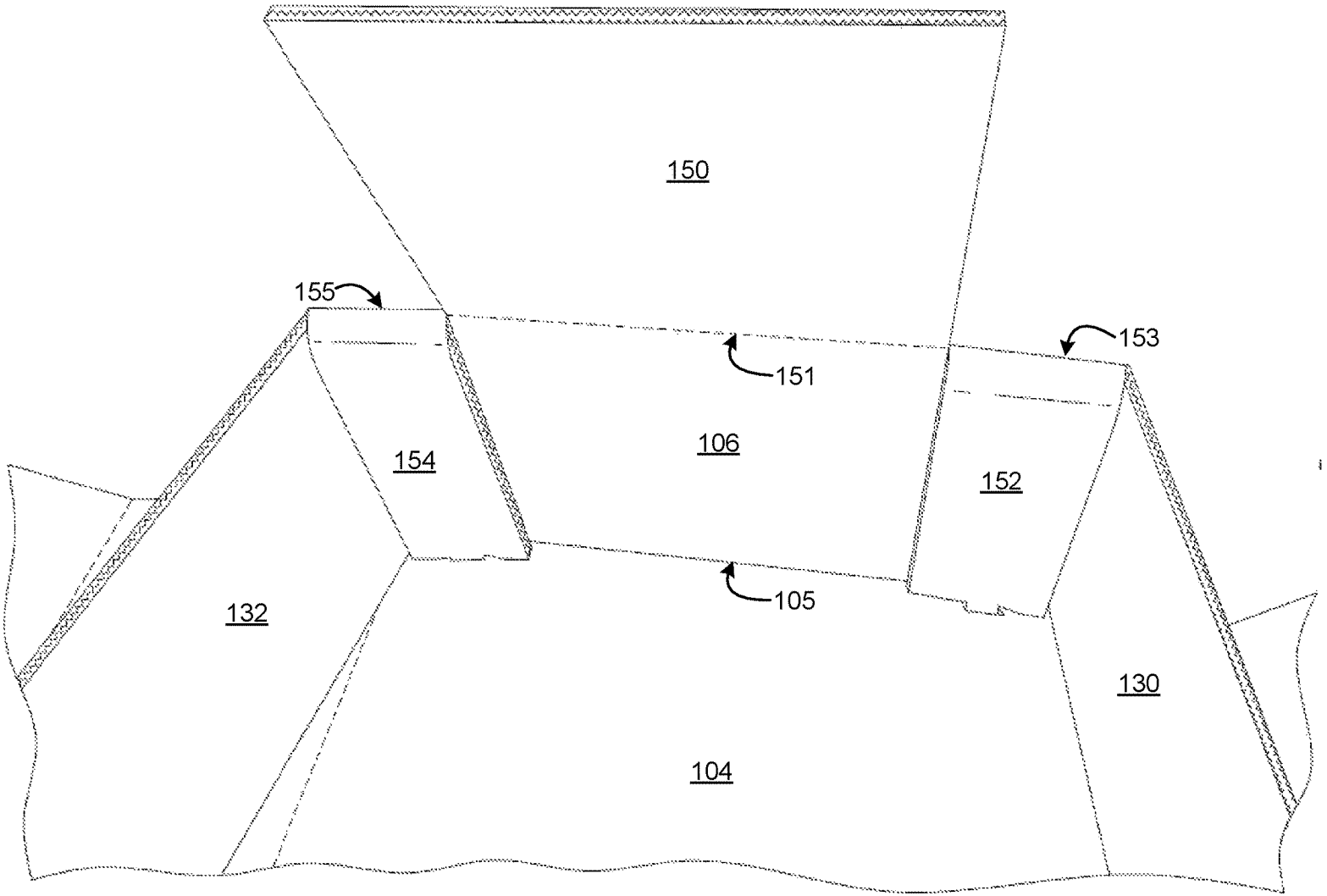
FIG. 2 is a perspective view of a partial folding operation of a front panel assembly of the container of FIG. 2, according to embodiments of the present disclosure.

FIG. 2 is a perspective view of a partial folding operation of a front panel assembly of the blank 100 of FIG. 1 for forming the container 101, according to embodiments of the present disclosure. The formation of the container 101 from the blank 100 will be described according to one exemplary method of the disclosure. To illustrate assembled front panel 210, FIG. 2 is described within the context of the blank 100 of FIG. 1.

The formation of the assembled front panel 210 can proceed by folding the front panel 106 at the fold line 105 to a respective substantially upright, e.g., substantially perpendicular configuration relative to the base panel 104. Formation can proceed by folding the front support flaps 152 and 154 to a respective substantially downward, e.g., substantially parallel configuration relative to the front panel 106. When folding the front support flaps 152 and 154 downward, tabs 157 and 158 can be inserted into apertures 170 and 172, respectively. By inserting the tabs 157 and 158 into the apertures 170 and 172, the front support flaps are secured into place. In some embodiments, the front support flaps provide additional support for the container 101 by providing increased compression strength to an assembled container 101 without the need for glue or staples. In some embodiments, this can be due to, at least in part, the assembled front panel 210 having additional multiple layers of corrugation when fully assembled. It should be understood that formation of an assembled back panel (not shown) can proceed in a substantially similar manner as formation of the assembled front panel 210.

Figure 3:
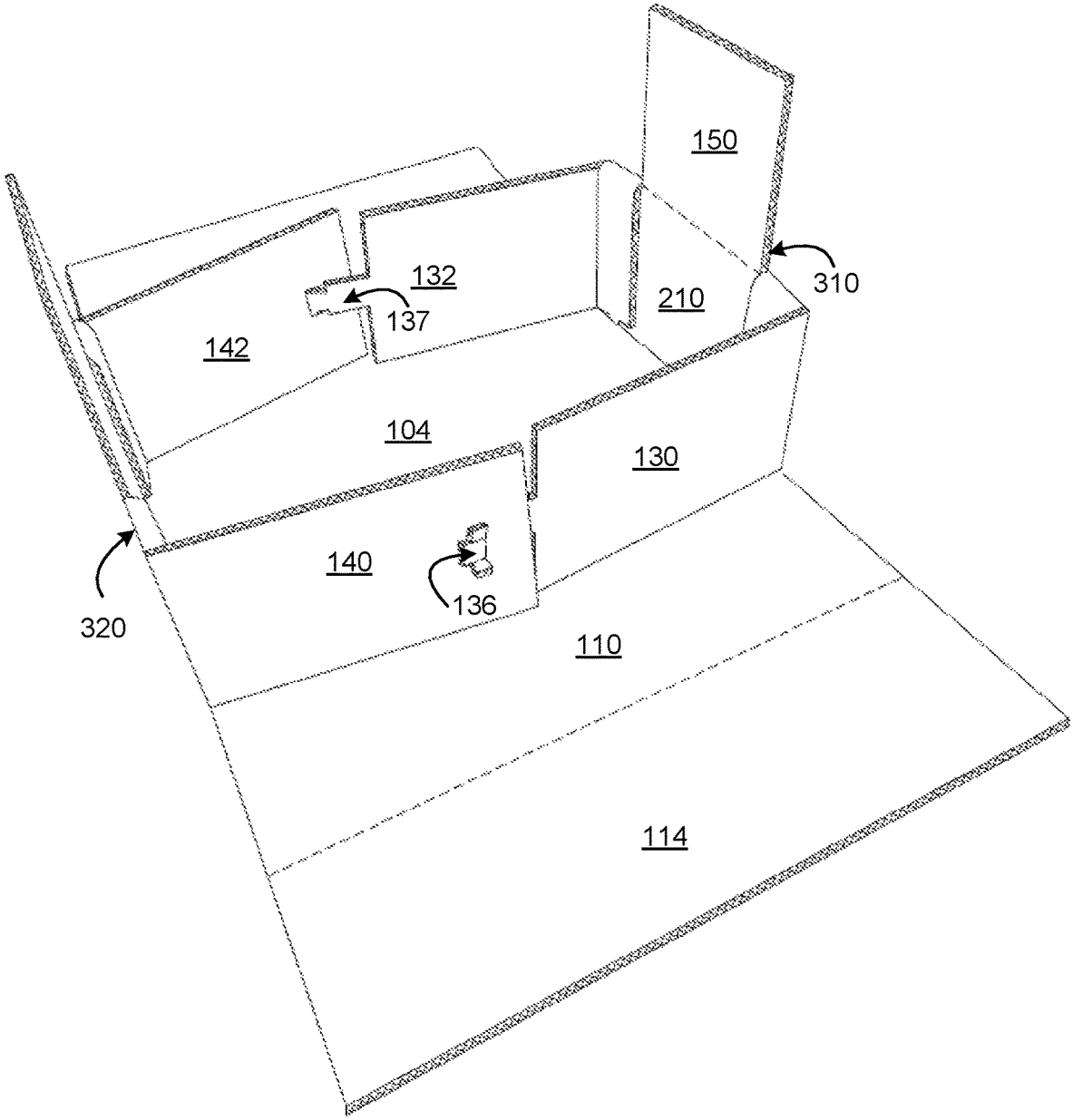
FIG. 3 is a perspective view of a partial folding operation of a side panel of the container of FIG. 2, according to embodiments of the present disclosure.

FIG. 3 is a perspective view of a partial folding operation of a side panel assembly of the blank 100 of FIG. 1 for forming the container 101, according to embodiments of the present disclosure. The formation of the container 101 from the blank 100 will be described according to one exemplary method of the disclosure. To illustrate assembled side panels 310 and 320, FIG. 3 is described within the context of the blank 100 of FIG. 1.

The formation of the assembled side panel 310 can proceed once the formation of the assembled front panel 210 and the assembled back panel are complete. Formation can then proceed by folding the front inner side panel 130 substantially inward toward the fold line 109. The front inner side panel 130 being substantially perpendicular to the assembled front panel 210. The formation proceeds by folding the back inner side panel 140 substantially inward toward the fold line 109. The back inner side panel being substantially perpendicular to the assembled back panel. The tab 135 can be inserted into aperture 144 in such a way as to allow the latch 136 to protrude toward the exterior of the container 101. The formation proceeds by folding the outer side panel 110 at the fold line 109 to a respective substantially upright, e.g., substantially perpendicular, configuration relative to the base panel 104 (not shown).

The formation of the assembled side panel 310 proceeds by folding the front inner side panel 132 substantially inward toward the folding line 111. The front inner side panel 132 being substantially perpendicular to the assembled front panel 210. The formation proceeds by folding the back inner side panel 142 substantially inward toward the fold line 11. The back inner side panel being substantially perpendicular to the assembled back panel. The tab 137 can be inserted into aperture 146 in such a way as to allow the latch 138 to protrude toward the exterior of the container 101. The formation proceeds by folding the outer side panel 112 at the fold line 111 to a respective substantially upright, e.g., substantially perpendicular, configuration relative to the base panel 104 (not shown).

Figure 4:
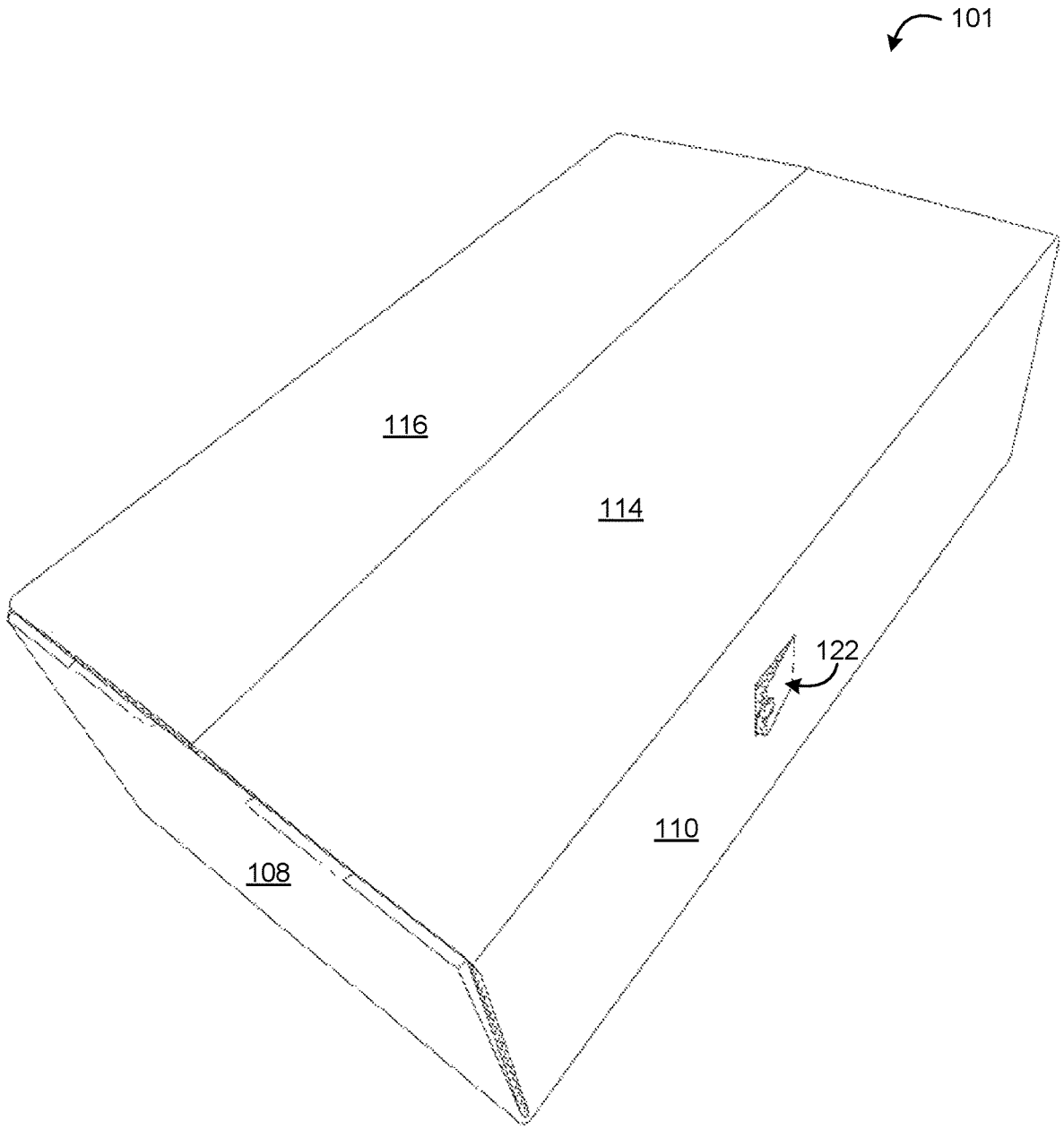
FIG. 4 is a perspective view of a container formed from the blank of FIG. 1, according to embodiments of the present disclosure.

FIG. 4 is a perspective view of a container formed from the blank of FIG. 1, according to embodiments of the present disclosure. To illustrate the container 101, FIG. 4 is described within the context of the blank 100 of FIG. 1. The container 101 is illustrated in a closed condition, with the front minor flap 150 and the back minor flap 160 folded into the interior of the container 101 with the major flaps 114 and 116 folding over the top of the front minor flap 150 and the back minor flap 160. In this regard, the container 101 provides an enclosure, for example, to maintain a desired condition of the interior of the container 101, or for a storage system disposed therein. A user can selectively open the container 101 by rotating the activation windows 122 and 126 away from the container 101 and depressing the latchs 136 and 138 into the interior of the container 101. The container 101 can self-activate and partially disassemble back into a blank formation revealing the contents of the interior.

Referring to FIGS. 1-4, blank 100 and container 101 may be made of any suitable material or combination of materials, including without limitation, wood, natural or artificial polymers, natural or artificial textile materials, materials created by molding or otherwise joining fibers, including without limitation paper or fiberboard, metal, composite material, such as fiberglass, or any combination thereof. Materials may be joined together in any suitable configuration to form blank 100 or container 101, including corrugated board material, in which at least one sheet of material or materials is fluted or pleated to create a series of ridges and troughs that enhance the strength of the sheet; a corrugated sheet may be adhered to one or more flat sheets of the same or different materials, or may be sandwiched between two sheets, as is commonly seen in corrugated board material, boxboard, plastic shipping materials, and the like. In some embodiments, all or the majority of the blank 100 or container 101 is made from the same material.

In general, the blanks herein may also be constructed from paperboard having a caliper so that it is heavier and more rigid than ordinary paper. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either, or both sides of the blank. The blanks can also be laminated to or coated with one or more sheet-like materials at selected panels or panel sections.

In accordance with various embodiments, a fold line can be substantially linear, although not necessarily straight, for weakening a material to facilitate folds there along. More specifically, but not for the purpose of narrowing the scope of the present disclosure, fold lines include: a score line, such as lines formed with a blunt scoring knife, or the like, which creates a crushed or depressed portion in the material long the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonably user to incorrectly consider the fold line to be a tear line.

The above embodiments may be described as having one or more panels adhered together by glue during erection of the container embodiments. The term "glue" is intended to encompass all manner of adhesives commonly used to secure portion of the container in place, and is not intended to exclude heat, chemical, or frequency bonding techniques.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A blank for forming a container comprising:

a plurality of panels connected together at fold lines configured for extending around an interior space, including a base panel, a front panel, a back panel, a first outer side panel, and a second outer side panel;

a pair of front inner side panels foldably connected to opposed edges of the front panel;

a front minor flap foldably connected to a top edge of the front panel;

a pair of front support flaps foldably connected to the top edge of the front panel and on opposed sides of the front minor flap;

a pair of back inner side panels foldably connected to opposed edges of the back panel;

a back minor flap foldably connected to a top edge of the back panel;

a pair of back support flaps foldably connected to the top edge of the back panel and on opposed sides of the back minor flap;

a first major flap foldably connected to a top edge of the first outer side panel;

a first winged tab connected to an edge of a first one of the front inner side panels including a latch;

a first back side aperture positioned by an edge of a first one of the back inner side panels, wherein the first winged tab is configured to be inserted into the first back side aperture when forming a first assembled side panel and the latch protruding toward an exterior of the first assembled side panel;

a first activation window on the first outer side panel and positioned such that the first activation window is parallel to the first back side aperture, wherein the first activation window is configured to rotate away from first outer side panel;

a second major flap foldably connected to a top edge of the second outer side panel, wherein a first one of the front inner side panels, a first one of the back inner side panels, and the first outer side panel are configured to form a first assembled side panel, wherein a second one of the front inner side panels, a second one of the back inner side panels, and the second outer side panel are configured to form a second assembled side panel, wherein the pair of front support flaps and the front panel are configured to form an assembled front panel, wherein the pair of back support flaps and the back panel are configured to form an assembled back panel, and wherein the first major flap, the second major flap, the front minor flap, and the back minor flap are configured to form an assembled top panel.

2. The blank of claim 1, further comprising:

a pair of front tabs connected to edges of the front support flaps;

a pair of back tabs connected to edges of the back support flaps;

a pair of front apertures positioned along a front edge of the base panel; and a pair of back apertures positioned along a back edge of the base panel, wherein the front tabs are configured to be inserted into the front apertures when forming the assembled front panel, and wherein the back tabs are configured to be inserted into the back apertures when forming the assembled back panel.

3. The blank of claim 1, wherein the blank is made of corrugated board material.

4. The blank of claim 1, further comprising:

a second winged tab connected to an edge of a second one of the front inner side panels; and a second back side aperture positioned by an edge of a second one of the back inner side panels, wherein the second winged tab is configured to be inserted into the second back side aperture when forming the second assembled side panel.

5. The blank of claim 4, further comprising:

a second activation window on the second outer side panel and positioned such that the first activation window is parallel to the second back side aperture.

6. A container comprising:

a plurality of panels extending at least partially around an interior space, including a base panel connected to an assembled front panel, an assembled back panel, a first assembled side panel, and to a second assembled side panel;

a pair of front inner side panels foldably connected to opposed edges of the assembled front panel;

a front minor flap foldably connected to a top edge of the assembled front panel;

a pair of front support flaps foldably connected to the top edge of the assembled front panel and on opposed sides of the front minor flap;

a pair of back inner side panels foldably connected to opposed edges of the assembled back panel;

a back minor flap foldably connected to a top edge of the assembled back panel;

a pair of back support flaps foldably connected to the top edge of the back panel and on opposed sides of the back minor flap;

a first major flap foldably connected to a top edge of the first assembled side panel;

a second major flap foldably connected to a top edge of the second assembled side panel;

a first winged tab connected to an edge of a first one of the front inner side panels including a latch;

a first back side aperture positioned by an edge of a first one of the back inner side panels, wherein the first winged tab is configured to be inserted into the first back side aperture when forming a first assembled side panel and the latch protruding toward an exterior of the first assembled side panel;

a first activation window on the first outer side panel and positioned such that the first activation window is parallel to the first back side aperture, wherein the first activation window is configured to rotate away from first outer side panel; and wherein the first activation window conceals the first winged tab configured to partially disassemble the container when depressed.

7. The container of claim 6, wherein a first one of the front inner side panels, a first one of the back inner side panels, and a first outer side panel are configured to form the first assembled side panel.

8. The container of claim 6, wherein a second one of the front inner side panels, a second one of the back inner side panels, and a second outer side panel are configured to form the second assembled side panel.

9. The container of claim 6, wherein the pair of front support flaps and a front panel are configured to form the assembled front panel.

10. The container of claim 6, wherein the pair of back support flaps and a back panel are configured to form the assembled back panel.

11. The container of claim 6, wherein the first major flap, the second major flap, the front minor flap, and the back minor flap are configured to form an assembled top panel.

12. The container of claim 6, wherein the container is made of corrugated board material.

13. The container of claim 6, wherein the front support flaps and the back support flaps provide increased compression strength along the assembled front panel and the assembled back panel.

* * * * *